US006863555B2

(12) United States Patent
Ito

(10) Patent No.: US 6,863,555 B2
(45) Date of Patent: Mar. 8, 2005

(54) POWER-CORD CONNECTING SET

(76) Inventor: Yoshinobu Ito, 29-15-1202, Honcho 3-Chome, Nakano-ku, Tokyo 164-0012 (JP)

( * ) Notice: Subject to any disclaimer, the term of this patent is extended or adjusted under 35 U.S.C. 154(b) by 0 days.

(21) Appl. No.: 10/204,628

(22) PCT Filed: Feb. 22, 2001

(86) PCT No.: PCT/JP01/01318

§ 371 (c)(1),
(2), (4) Date: Jan. 3, 2003

(87) PCT Pub. No.: WO01/63702

PCT Pub. Date: Aug. 30, 2001

(65) Prior Publication Data

US 2003/0157824 A1 Aug. 21, 2003

(30) Foreign Application Priority Data

| | | |
|---|---|---|
| Feb. 22, 2000 | (JP) | 2000-105566 |
| Apr. 3, 2000 | (JP) | 2000-136391 |
| Jan. 29, 2001 | (JP) | 2001-000345 |
| Feb. 7, 2001 | (JP) | 2001-000509 |

(51) Int. Cl.[7] ..... H01R 13/627
(52) U.S. Cl. ..... 439/353; 439/358
(58) Field of Search ..... 439/350, 358, 439/357, 353, 271, 281, 389, 587–589, 374, 369

(56) References Cited

U.S. PATENT DOCUMENTS

| | | | | | |
|---|---|---|---|---|---|
| 2,748,362 | A | * | 5/1956 | Andis | 439/358 |
| 2,895,119 | A | * | 7/1959 | Montgomery, Jr. | 439/353 |
| 4,255,007 | A | * | 3/1981 | Michaels et al. | 439/353 |
| 4,431,244 | A | * | 2/1984 | Anhalt et al. | 439/358 |
| 5,080,603 | A | * | 1/1992 | Mouissie | 439/353 |

FOREIGN PATENT DOCUMENTS

| | | | |
|---|---|---|---|
| EP | 0831560 a | | 3/1998 |
| JP | 63179672 | U | 11/1988 |
| JP | 04135186 | U | 12/1992 |
| JP | H8-255651 | A | 10/1996 |
| JP | 2000-182732 | A | 6/2000 |
| JP | 2000-340286 | A | 12/2000 |
| JP | 3079264 | U | 8/2001 |
| JP | 3079478 | U | 8/2001 |
| JP | 2001-237021 | | 8/2001 |
| JP | 2001-283985 | | 10/2001 |

* cited by examiner

*Primary Examiner*—P. Austin Bradley
*Assistant Examiner*—Felix O. Figueroa
(74) *Attorney, Agent, or Firm*—Mark M. Friedman

(57) ABSTRACT

A power-cord connection set including a plug and an outlet, wherein an annular joining protrusion having a tapered cross-section is provided around the terminals of the plug and an annular joining depression having a tapered cross-section and corresponding to the annular joining protrusion is provided around the terminal receptors of the outlet.

3 Claims, 6 Drawing Sheets

POWER-CORD CONNECTING SET

BACKGROUND OF THE INVENTION

1. Field of the Invention

The present invention relates to a power-cord connection set intended primarily for use with electric or electronic equipment.

2. Description of the Related Art

A general power-cord connection set that is well-known in the art includes a plug provided with a pair of plug terminals mounted in a plug case and an outlet provided with a pair of terminal receptors mounted in an outlet case. Various plugs, such as those described in published unexamined Japan patent applications Nos. HEI-8-255651 and 2000-182732, and outlets, such as those described in published unexamined patent application No. 2000-340286, have been proposed. These plugs and outlets are provided with connectors for forming a junction and connecting the lead wires provided in the plug's power cord.

These connection sets are designed primarily for connecting lead wires of electric or electronic equipment. However, neither the power connection (and when necessary the ground connection) nor the connection of the plug and outlet units themselves is sufficiently reliable. If the plug and outlet are left connected for a long period of time, dust might collect at the connection and generate sparks. Further, water entering the connection area might cause a short circuit that can cause a fire.

Because the voltage used in power-cord connection sets having a ground wire is particularly high, the ground wire is designed to eliminate static electricity that is in the plug case and the outlet case that is generated by current flowing through those cases. However, if dust from the surrounding air is electrostatically attracted to the surface of a plug case or outlet case that is charged with static electricity, the dust collecting on the surface can cause sparks at the electrical connecting point between the plug and outlet, resulting in fire.

SUMMARY OF THE INVENTION

In view of the foregoing, it is an object of the present invention to provide a power-cord connection set that has a simple construction, that is capable of achieving a reliable connection between power cables in the outlet and power cables in the of electric or electronic equipment, and that is capable of sealing the electrically conducting area from external matter. Another object of the present invention is to provide—by a simple, compact, and economic structure—a power-cord connection set that has excellent sealing properties. Yet another object of the present invention is to provide a power-cord connection set that has a ground wire having a conducting member for the ground wire at the area of electrical connection between the plug and the outlet, and that is capable of maintaining a seal around this area.

These objects and others will be attained by a power-cord connection set comprising: a plug (P) having a plug case (2) and a pair of plug terminals (1) mounted in the plug case (2); a hollow plug adapter (A) that is detachably mounted on the plug case (2) and that comprises both a space for inserting the plug case (2) and an annular joining protrusion (9) that has a tapered cross-section that is positioned around the plug terminals (1) when the plug case (2) is inserted to a prescribed position; an outlet (C) that has an outlet case (4) and a pair of terminal receptors (3) mounted in the outlet case

(4); an annular joining depression (10) that has a tapered cross-section and that is positioned around the insertion holes of the terminal receptors (3) in the outlet case (4) and formed so as to correspond to the annular joining protrusion (10); wherein the annular joining protrusion (9) further has an annular-plug insulating connector (7) protruding from the side of said protrusion (9) which faces the outlet (6); the outlet case (4) comprises both an annular joining depression (10), and an annular-outlet insulating connector (8) that is built into the base end of, the annular joining depression (10) and that has receiving holes **(8*a*) corresponding to the plug terminals (1); the annular joining depression (10) and the annular-outlet insulating connector (8) both have a tapered cross-section such that the combined form thereof can fit the combined form of the annular joining protrusion (9) and the annular-plug insulating connector (7)**.

According to another variation of the present invention, a power-cord connection set having a ground function comprises: a plug (P) having a plug case (2) and a pair of plug terminals (1) mounted in the plug case (2); wherein the plug case (2) has a plug adapter portion that comprises both a pair of holes through which each of the plug terminals (1) is fit, and an annular joining protrusion (9) that has a tapered cross-section and that is positioned around the plug terminals (1) in the plug case (2); an outlet (C) that has an outlet case (4) and a pair of terminal receptors (3) mounted in an outlet case (4); an annular joining depression (10) that has a tapered cross-section and that is positioned around the insertion holes of the terminal receptors (3) in the outlet case (4) and that is formed so as to correspond to the annular joining protrusion (10); wherein: the plug-adapter portion further comprises an annular hole which is provided through the annular joining protrusion (9); an annular-plug ground connector (7) that is fit within the annular hole while said connector (7) protrudes through the annular joining protrusion (9) from the side of said protrusion (9) which faces the outlet (C); the outlet (C) further comprises an annular-outlet ground connector (8) corresponding to the annular-plug around connector (7); the outlet case (4) comprises the annular joining depression (10) as well as the insertion holes of the terminal receptors (3): the annular joining depression (10) has: (a) a tapered portion that can fit the tapered portion of the annular joining protrusion (9); (b) an annular receiving hole **(8*a*) through which the annular-plug ground connector (7) can pass; and (c) an opening in which the annular-outlet ground connector (8)** is fit.

A variation of the present invention could be to detachably mount a hollow plug adapter on the plug case. The plug adapter has a space for inserting the plug case and an annular joining protrusion that has a tapered cross-section and that is formed around the plug terminals when the plug case is inserted to a prescribed position. An annular joining depression that has a tapered cross-section is formed on the outlet Case and is positioned around the insertion openings of the built-in terminal receptors so as to correspond to the annular joining protrusions. A connector is built into the base of the annular joining depression, and said connector the plug case and an annular joining protrusion that has a tapered cross-section and that is formed around the plug terminals when the plug case is inserted to a prescribed position. An annular joining depression that has a tapered cross-section is formed on the outlet Case and is positioned around the insertion openings of the built-in terminal receptors so as to correspond to the annular joining protrusions. A connector is built into the base of the annular joining depression, and said connector has a receiving hole corresponding to the connector of the plug.

In these embodiments, elastic hooks should be formed on the plug case or plug adapter for applying an outward urging force, and hook-engaging units corresponding to the ends of the hooks should be formed on the opening end of the annular joining depression. Further, it is desirable to provide a retaining unit on the back of the case so as to maintain the electric cords (and ground lead wires) for the plug and outlet in an insulated state.

DESCRIPTION OF THE PREFERRED EMBODIMENTS

Figure 1:
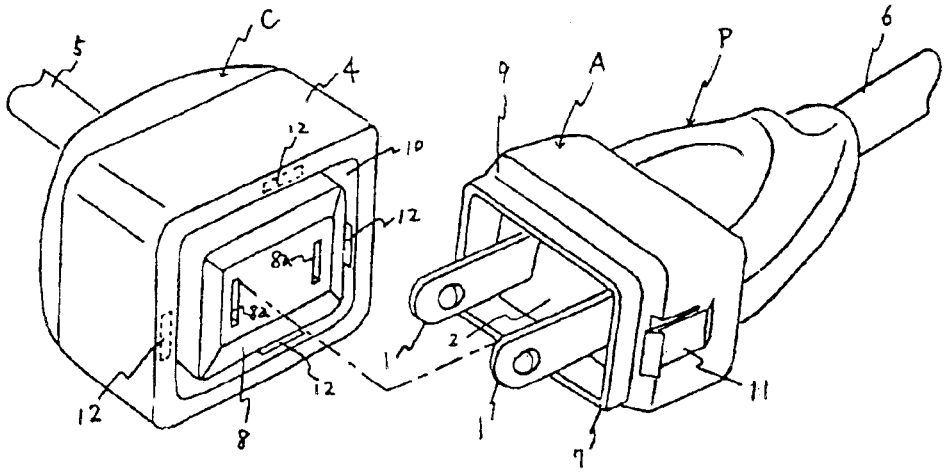
FIG. 1 is a perspective view showing the outlet and plug of the power-cord connection set according to a first embodiment in an unconnected state.
Figure 2:
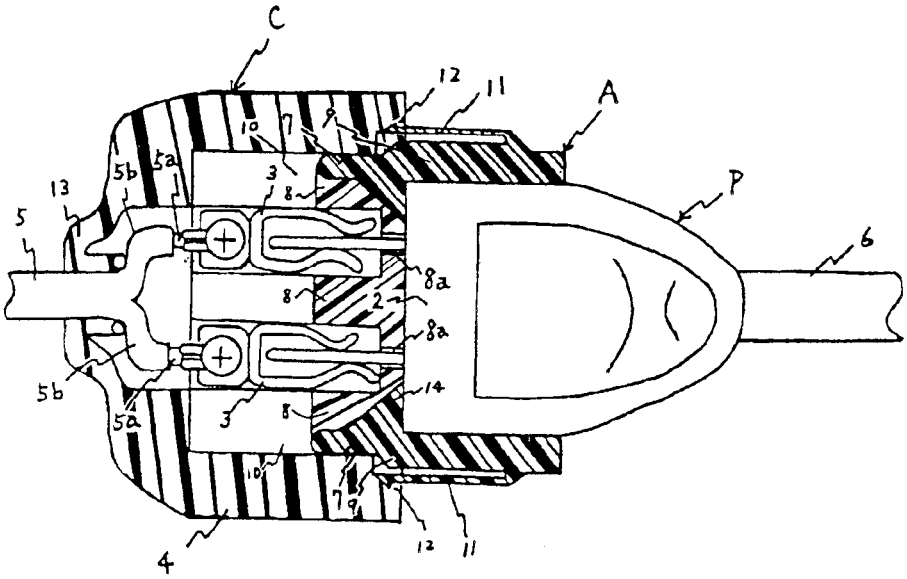
FIG. 2 is a is a cross-sectional plan view showing the outlet and plug of the power-cord connection set of FIG. 1 in a connected state.

A power-cord connection set according to preferred embodiments of the present invention will be described while referring to the accompanying drawings. A power-cord connection set according to a first embodiment is shown in FIGS. 1 and 2.

The power-cord connection set of the first embodiment includes a plug P, a hollow plug adapter A, and an outlet C appropriately connecting lead wires that are provided in an electric cord 5 for the outlet C and an electric cord 6 for the plug. The plug P includes a pair of plug terminals 1 and a plug case 2 in which the power plug terminals 1 are mounted. The plug case 2 is composed of an insulating material, such as a hard synthetic resin. The hollow plug adapter A is detachably mounted on the plug P. The outlet C includes a pair of terminal receptors 3 that correspond to the pair of plug terminals 1 and an outlet case 4 in which the terminal receptors 3 are mounted.

In the present embodiment, the electric cord 5 and electric cord 6 are provided with lead wires 5*a* and insulating sheathes 5*b* formed around the lead wires 5*a*.

Figure 3:
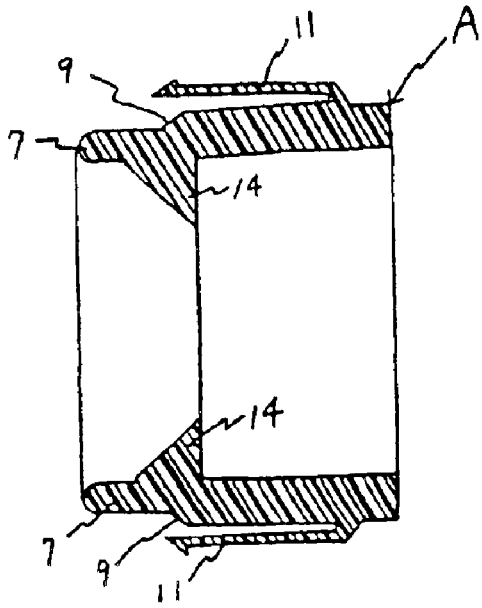
FIG. 3 is a cross-sectional plan view showing the plug adapter of FIG. 1.

As shown by FIG. 3, the hollow plug adapter A, which is mounted on the plug case 2, is hollow and preferably formed of a synthetic resin having slight elasticity. The hollow plug adapter A includes a space in which the plug case 2 is inserted. An annular joining protrusion 9 portion having a tapered cross-section is formed at the outlet C end of the plug adapter A, around the plug terminals 1. An annular-plug insulating connector 7 portion further protrudes from the outlet C end of the annular joining protrusion 9. When necessary, an engaging step 14 is formed on the inner surface of the plug adapter A so as to prevent the plug case 2 from being inserted past a prescribed position.

An annular joining depression 10 having a tapered cross-section is formed in the outlet case 4 around insertion openings for the terminal receptors 3 and corresponding to the annular joining protrusion 9. The base end of the annular joining depression 10 is provided with an annular-outlet insulating connector 8 corresponding to the annular-plug insulating connector 7 of the plug adapter A. The annular-outlet insulating connector 8 is formed with receiving holes 8*a* corresponding to the plug terminals 1. Here, both the annular joining depression 10 and the annular-outlet insulating connector 8 have a tapered cross-section such that the combined form thereof can fit the combined form of the annular joining protrusion 9 and the annular-plug insulating connector 7.

Hooks 11 formed of an elastic material that provides an outward urging force are provided on the left and right side, (or on the top and bottom) of the plug adapter A. Hook-engaging units 12 are formed near the opening lip of the annular joining depression 10, and the hook-engaging units 12 correspond to the ends of the hooks 11. Although FIGS. 1 and 2 show the hook-engaging units 12 spanning the inner and outer edges of the opening in the annular joining depression 10, the hook-engaging units 12 can also be positioned only in the tapered surface of the inner edge. In this case, it is possible to provide the inner opening of the annular joining depression 10 with a four-sided tapered surface for accommodating the hooks 11, which are positioned on the left and right or top and bottom of the plug case 2.

The plug P and the outlet C have the electric cord 5 and 6, respectively, on the rear thereof such that the same are in an insulated state with each other.

With this configuration, the combined tapered profile of the annular joining depression 10 and the annular-outlet insulating connector 8, serves: first, by receiving the annular-plug insulating connector 7 portion, as such a guide that the plug terminals 1 are inserted into the terminal receptors 3 so as to connect the plug P to the outlet C; and second, by said contacting with the tapered profile of the annular joining protrusion 9, the resultant juncture completes the sealing. Accordingly, the plug terminals 1 are guided, through the receiving holes 8*a*, into the correct positions of the terminal receptors 3, thereby achieving a reliable connection between the power terminals 1 and 2.

Figure 4:
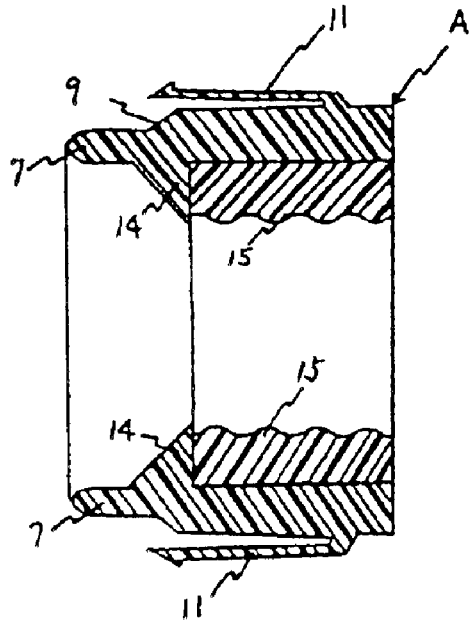
FIG. 4 is a cross-sectional plan view showing the plug adapter according to a variation of the embodiment.

As shown in FIG. 4, a soft layer 15 that is composed of a foam resin such as urethane and that has an appropriate thickness can be provided on the inner surface of the plug adapter A. With this configuration, the soft layer 15 is compressed when the plug case 2 is inserted into the plug adapter A, thereby creating a mechanical retaining force with the plug adapter A to accommodate the plug case 2 in a stable state. The outlet C shown in FIGS. 1 through 4 is shaped to conform to the plug P. It is also possible to provide either a tap outlet that is capable of connecting with a plurality of plugs P, or an embedded outlet that is embedded in a wall or in a box outlet that protrudes from a wall, in order to connect one or a plurality of plugs P.

In the power-cord connection set of the present embodiment, a plug adapter A is detachably mounted on the plug case 2. The plug adapter A is provided with a tapered annular joining protrusion 9 around the plug terminals 1 and with an annular-plug insulating connector 7 that further protrudes from the side of said protrusion (9) which faces the outlet (C). A tapered annular joining depression 10 is formed in the outlet case 4 around the insertion openings for the built-in terminal receptors 3, and the annular joining depression 10, corresponds to the aforementioned annular joining protrusion 9. An annular-outlet insulating connector 8 is provided on the base end of the annular joining depression 10, and the annular-outlet insulating connector 8 has receiving holes 8*a* corresponding to the plug terminals 1. Here, the annular joining protrusion 9 makes a complementary, tapered profile that fits the set of the tapered portions of both the annular outlet connector 8 and the annular joining insulating depression 10, whereby the outer side of said protrusion 9 fits the outer side of said depression 10, while the inner side of said protrusion 9 fits the outer side of said connector 8.

Accordingly, the present invention enables, by mounting a plug adapter on a conventional plug, both easy insertion of the plug into the outlet and a reliable, electrical connection between the outlet and the plug. Further, a seal is formed by fitting the tapered annular joining portions together, thereby effectively preventing dust or the like from entering the terminal receptor area.

Next, a power-cord connection set according to a second embodiment of the present invention will be described with reference to FIGS. 5 through 8.

A cord connection set having a grounding function, according to the second embodiment, includes a plug P and an outlet C for appropriately connecting lead wires provided in an electric cord 5 for the outlet and an electric cord 5 for the plug. The plug P includes a pair of plug terminals 1, a plug case 2 in which the power plug terminals 1 are mounted, and an annular-plug ground connector 7. The plug case 2 is composed of an insulating material such as a hard synthetic resin. The outlet C includes a pair of terminal receptors 3 corresponding to the pair of plug terminals 1, an outlet case 4 in which the terminal receptors 3 are mounted, and an annular-outlet ground connector 8.

In the present embodiment, the electric cords 5 are provided with lead wires 5*a*, insulating sheathes 5*b* that are formed around the lead wires 5*a*, and ground lead wires 6 including a plurality of thin metal wires that cover the outside of the insulating sheathes 5*b* in a braided form. The ground lead wires 6 are connected to the annular-plug ground connector 7 in the plug P and to the annular-outlet ground connector 8 in the outlet C.

An annular joining protrusion 9 having a tapered cross-section is formed on the plug adapter portion of the plug case 2 around the plug terminals 1. The annular-plug ground connector 7, which is fit within the annular hole provided in the plug adapter portion and protrudes, through the annular joining protrusion 9, from the side of said protrusion (9) which faces the outlet (C). An annular joining depression 10 that has a tapered cross-section and that corresponds to the annular joining protrusion 9 is formed on the outlet case 4 around the terminal receptors 3. The annular-outlet ground connector 8 is provided on the base of the annular joining depression 10, and said annular-outlet ground connector 8 corresponds to the annular-plug ground connector 7. Here, the annular joining depression 10 has: (a) a tapered portion that can fit the tapered portion of the annular joining protrusion 9; (b) an annular receiving hole 8*a* through which the annular-plug ground connector 7 can pass; and (c) an opening in which the annular-outlet ground connector 8 is fit: and whereby (a), (b), and (c) are arranged to continue in this order.

Figure 5:
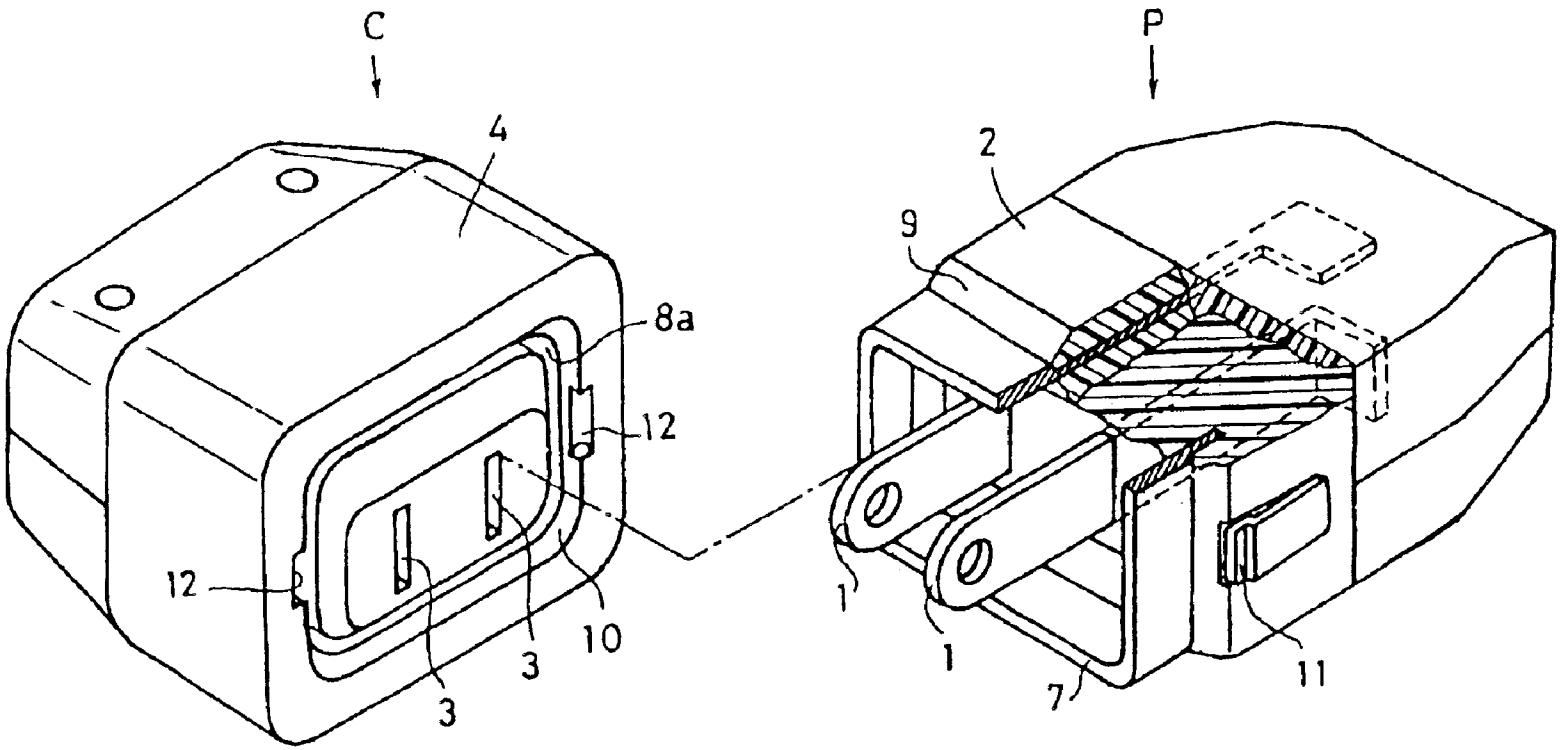
FIG. 5 is a perspective view showing the outlet and plug of the power-cord connection set according to a second embodiment.
Figure 6:
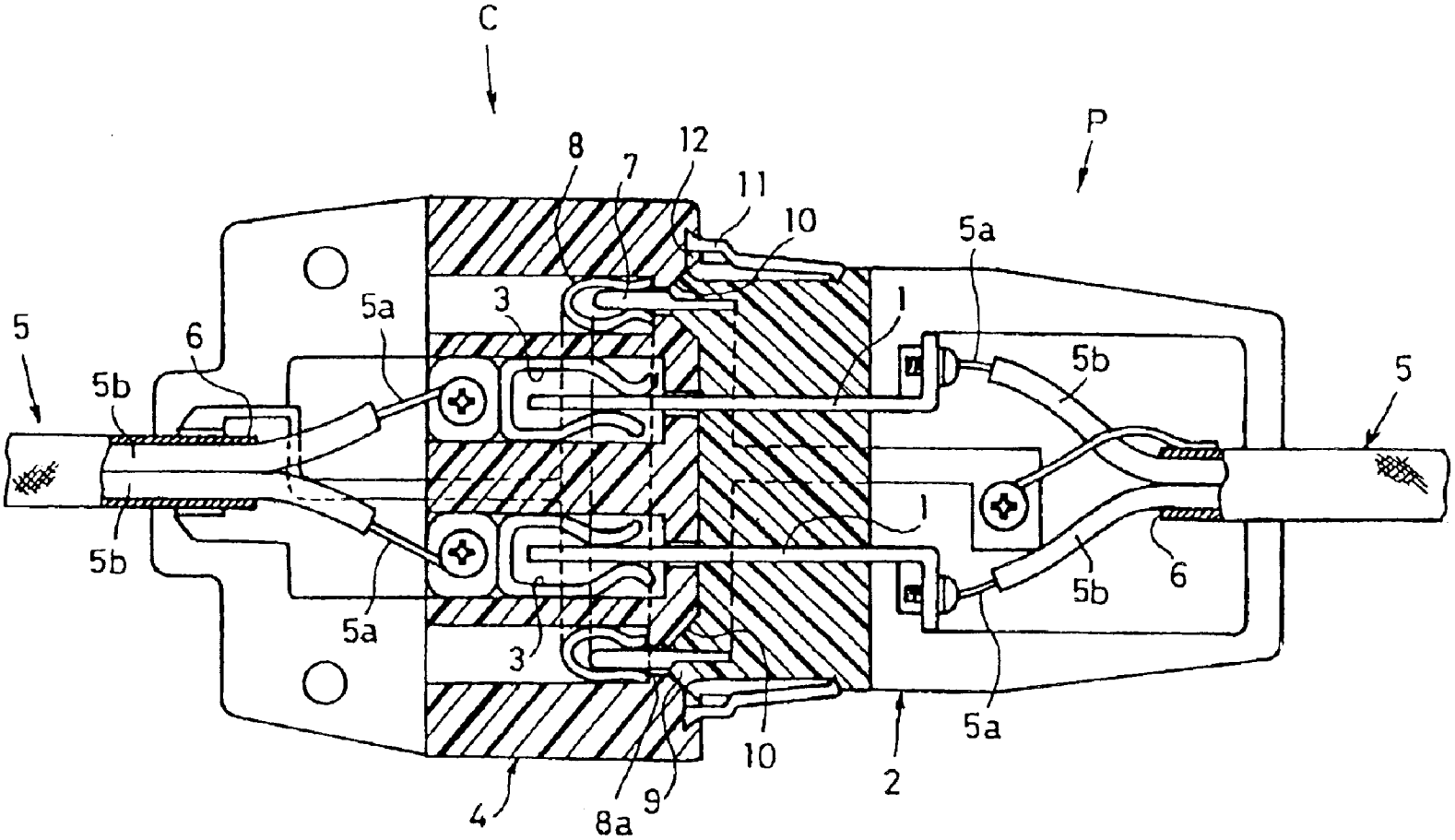
FIG. 6 is a cross-sectional plan view showing the power-cord connection set of FIG. 5 in a connected state.
Figure 7:
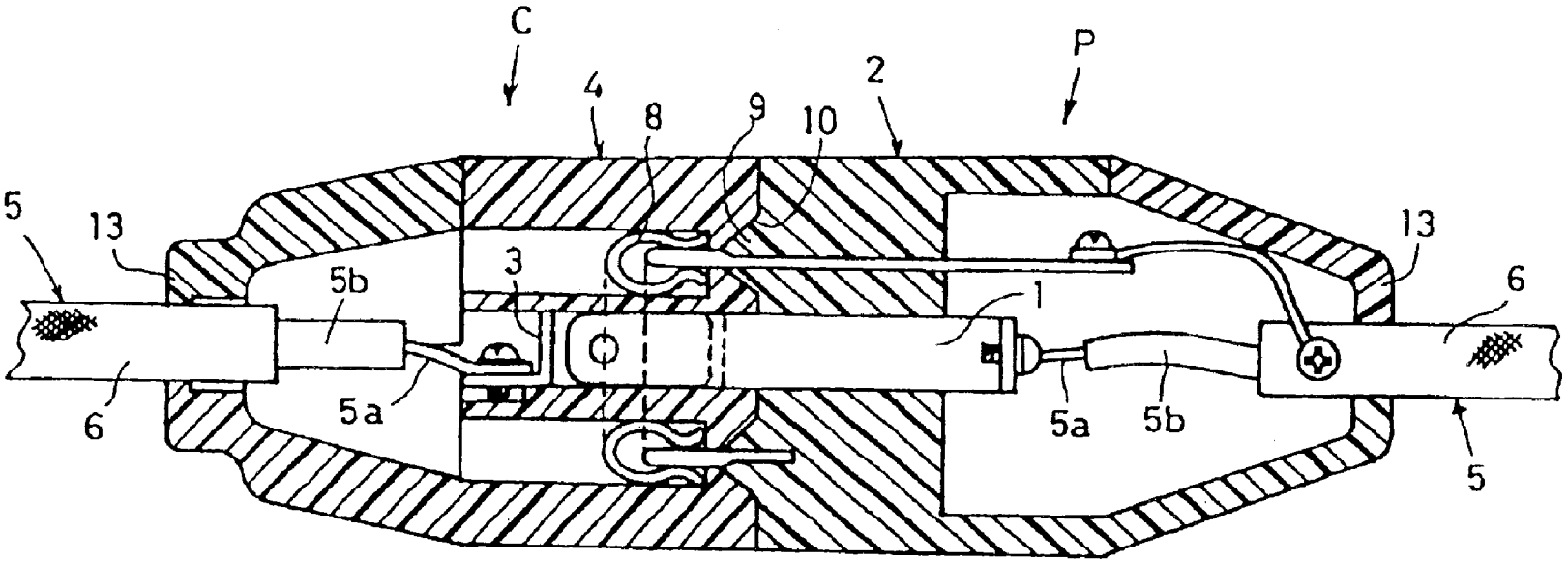
FIG. 7 is a side cross-sectional view showing the power-cord connection set of FIG. 5.
Figure 8:
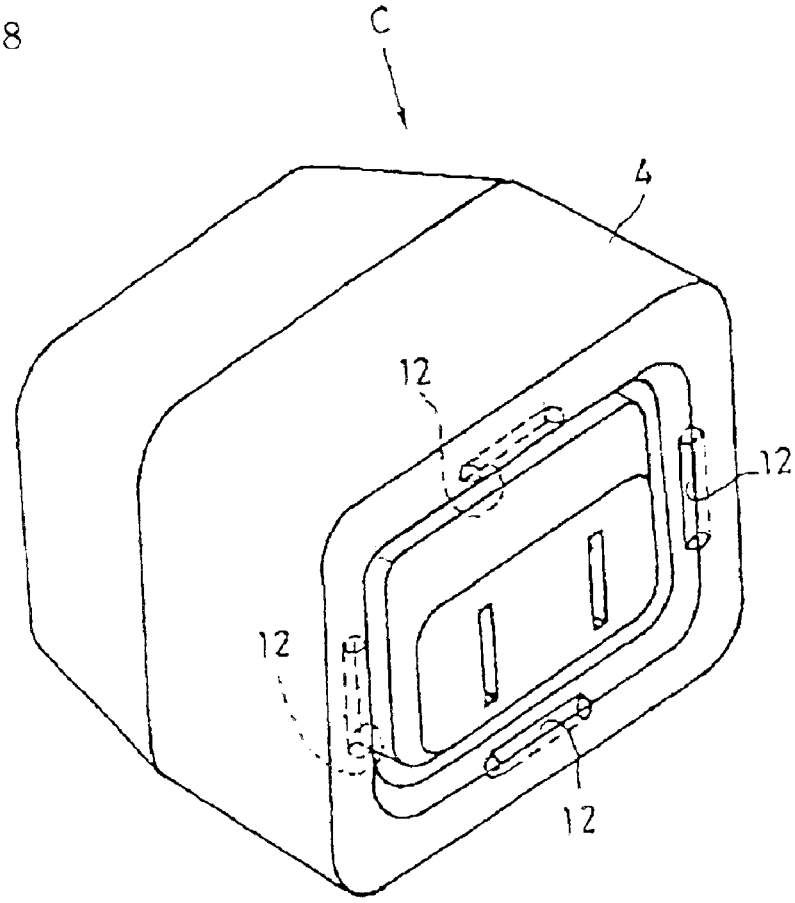
FIG. 8 is a perspective view showing the outlet case for the power-cord connection set of FIG. 5.

Hooks 11, formed of an elastic material, that provide an outward urging force are provided on the left and right side (or on the top and bottom) of the plug case 2. Hook-engaging units 12 are formed near the opening lip of the annular joining depression 10 and correspond to the ends of the hooks 11. Although FIGS. 5 and 6 show the hook-engaging units 12 straddling the inner and outer edge of the opening in the annular joining depression 10, the hook-engaging units 12 can also be positioned only in the tapered surface of the inner edge. In this case, it is possible to provide the inner opening of the annular joining depression 10 with a four-sided tapered surface for accommodating the hooks 11 positioned on the left and right or top and bottom of the plug case 2, as shown in FIG. 8.

In the present embodiment, the plug P and outlet C are provided with a retaining unit 13 that is well-known in the art for gripping and maintaining the electric cord 5 and ground lead wires 6 from above and below at the back of the plug case and outlet case in order to maintain the same in an insulated state.

With this configuration, the tapered profile of the annular joining depression 10, serves: first, by receiving the annular-plug ground connector 7 portion, as such a guide that the plug terminals 1 are inserted into the terminal receptors 3 so as to connect the plug P to the outlet C; and second, by contacting with the tapered profile of the annular joining protrusion 9, the resultant juncture completes the sealing. Accordingly, the plug terminals 1 are guided through the insertion holes of the terminal receptors 3 into the correct positions of the terminal receptors 3, thereby achieving a reliable connection between the power terminals 1 and 2.

The outlet C shown in FIGS. 5 through 8 is shaped to conform to the plug P. It is also possible to provide a tap outlet Capable of connecting with a plurality of plugs P, or an embedded outlet that is embedded in a wall or a box outlet that protrudes from a wall so as connect one or a plurality of plugs P. There are various other possible variations, such as providing a plug unit having the same shape as the plug P on one side of the tap outlet and forming a plurality of interconnectable tap outlets so as to create a series of tap outlets.

What is claimed is:

1. A power-cord connection set comprising:

a plug having a plug case and a pair of plug terminals mounted in the plug case;

a hollow plug adapter that is detachably mounted on the plug case and that comprises both a space for inserting the plug case and an annular joining protrusion that has a tapered cross-section that is positioned around the plug terminals when the plug case is inserted to a prescribed position;

an outlet that has an outlet case and a pair of terminal receptors mounted in the outlet case;

an annular joining depression that has a tapered cross-section and that is positioned around insertion holes of the terminal receptors in the outlet case and formed so as to correspond to the annular joining protrusion;

wherein the annular joining protrusion further has an annular-plug insulating connector protruding from a side of said protrusion which faces the outlet;

wherein the outlet case comprises both the annular joining depression, and an annular-outlet insulating connector that is built into a base end of the annular joining depression, the base end having receiving holes corresponding to the plug terminals;

wherein the annular joining depression and the annular-outlet insulating connector both have a tapered cross-section such that the annular joining depression and the annular-outlet insulating connector in combined form can fit the annular joining protrusion and the annular-plug insulating connector in combined form.

2. The power-cord connection set, according to claim 1, further comprising elastic hooks formed on the hollow plug adapter and hook engaging units on the annular joining depression, such that when the annular joining protrusion is fitted to the annular joining depression, the elastic hooks engage the hook engaging units.

3. The power-cord connection set, according to claim 1, wherein at least part of an inner surface of the hollow plug adapter is formed from an elastic material contacting the plug case so as to maintain a seal between the hollow plug adapter and the plug case.

* * * * *